US009943101B2

(12) United States Patent
Torrens et al.

(10) Patent No.: US 9,943,101 B2
(45) Date of Patent: Apr. 17, 2018

(54) PROCEDURE AND MACHINE FOR RECONSTITUTING POWDERS OF VEGETAL ORIGIN

(71) Applicant: IOTO INTERNATIONAL INDÚSTRIA E COMÉRCIO DE PRODUTOS AROMÁTICOS LTDA, Campo Magro (BR)

(72) Inventors: Gilson Luiz Torrens, Curitiba (BR); Bianca Iodice, Curitiba (BR)

(73) Assignee: IOTO INTERNATIONAL INDÚSTRIA E COMÉRCIO DE PRODUTOS AROMÁTICOS LTDA, Campo Magro (BR)

( * ) Notice: Subject to any disclaimer, the term of this patent is extended or adjusted under 35 U.S.C. 154(b) by 0 days.

(21) Appl. No.: 14/494,075

(22) Filed: Sep. 23, 2014

(65) Prior Publication Data

US 2015/0007839 A1 Jan. 8, 2015

Related U.S. Application Data

(63) Continuation of application No. 11/917,316, filed as application No. PCT/IB2006/052315 on Jul. 7, 2006.

(30) Foreign Application Priority Data

Jul. 8, 2005 (BR) ..... 0502934
Jul. 8, 2005 (BR) ..... 8501548 U

(51) Int. Cl.
*A24B 15/14* (2006.01)
*A24B 15/18* (2006.01)
(Continued)

(52) U.S. Cl.
CPC ..... *A24B 15/18* (2013.01); *A24B 3/14* (2013.01); *A24B 15/12* (2013.01); *A24B 15/14* (2013.01); *A24B 15/16* (2013.01)

(58) Field of Classification Search
CPC .... A23F 3/32; A24B 3/14; A24B 9/00; A24B 15/12; B02C 18/00; B02C 23/18; A23B 13/00; A23B 13/02
(Continued)

(56) References Cited

U.S. PATENT DOCUMENTS 170,469 A 11/1875 Chapin
2,151,527 A 3/1939 Podmore
(Continued)

FOREIGN PATENT DOCUMENTS

BR 8904742 A * 3/1991
EP 0238298 9/1987
(Continued)

OTHER PUBLICATIONS

APS Mixing Technology, Ribbon Blenders and other horizontal mixers; Brochure printed Apr. 1999; available at: http://www.cmtnc.com/Ribbon-Blender.pdf; accessed on Nov. 10, 2015.*
(Continued)

*Primary Examiner* — Michael J Felton
(74) *Attorney, Agent, or Firm* — Gottlieb, Rackman & Reisman, P.C.

(57) ABSTRACT

A procedure and machine for reconstituting powders of vegetal origin by lamination process, in which the machine includes a lamination device, a set of frontal and posterior drag rolls, a hot air insufflator, a thermal chamber and a conveyor, so that the vegetal mass is pressed by laminating rolls to obtain a pellicle of vegetal material that is deposited over the conveyor circulating inside a terminal chamber for drying the formed pellicle of vegetal material, which can be reinserted in industrial process.

1 Claim, 23 Drawing Sheets

(51) Int. Cl.
*A24B 3/14* (2006.01)
*A24B 15/16* (2006.01)
*A24B 15/12* (2006.01)

(58) Field of Classification Search
USPC ..... 131/353, 354, 355, 356, 357, 370, 371, 131/372, 373, 374, 375; 241/38, 65, 68; 426/285
See application file for complete search history.

(56) References Cited

U.S. PATENT DOCUMENTS

| | | | | |
|---|---|---|---|---|
| 2,743,826 | A * | 5/1956 | Aschenwald | A24B 3/12 131/306 |
| 3,053,259 | A | 9/1962 | Parmele et al. | |
| 3,076,729 | A | 2/1963 | Garbo et al. | |
| 3,081,779 | A * | 3/1963 | Perrin | A24B 15/12 131/372 |
| 3,308,556 | A | 3/1967 | Franklin et al. | |
| 3,709,232 | A * | 1/1973 | Lilja | A24B 3/14 131/372 |
| 3,796,222 | A | 3/1974 | Deszyck | |
| 4,167,191 | A | 9/1979 | Jewell et al. | |
| 4,337,783 | A | 7/1982 | Hooper et al. | |
| 4,522,217 | A | 6/1985 | D'Alterio | |
| 4,611,608 | A | 9/1986 | Vos et al. | |
| 4,730,629 | A | 3/1988 | Graves, Jr. et al. | |
| 4,768,527 | A | 9/1988 | Graves, Jr. | |
| 5,078,156 | A | 1/1992 | Furuya et al. | |
| 5,724,998 | A | 3/1998 | Gellatly et al. | |
| 5,743,022 | A | 4/1998 | Hall Taylor | |
| 5,944,026 | A * | 8/1999 | Kopsch | A24D 3/14 131/291 |
| 6,342,191 | B1 | 1/2002 | Kepner et al. | |
| 6,807,969 | B1 | 10/2004 | Wessinger et al. | |
| 2005/0039767 | A1 | 2/2005 | Mua et al. | |
| 2011/0067817 | A1 | 3/2011 | Iodice et al. | |

FOREIGN PATENT DOCUMENTS

| | | |
|---|---|---|
| EP | 0269396 | 6/1988 |
| FR | 1236272 | 7/1960 |
| GB | 2069814 | 9/1981 |

OTHER PUBLICATIONS

Brandes et al., Smithells Metals Reference Book, Butterworth Heinemann, No. month 1992, pp. 23-25.
Smithells Metals Reference Book, Seventh edition, published by Butterworth Heinemann, Published in 1992, p. 23-5.
Principles of Mineral Processing, Edited by Maurice et al., Society for Mining, Metallurgy, and Explaration, No month 2003, p. 125.

* cited by examiner

PROCEDURE AND MACHINE FOR RECONSTITUTING POWDERS OF VEGETAL ORIGIN

CROSS-REFERENCE TO RELATED APPLICATIONS

This application is a continuation of U.S. patent application Ser. No. 11/917,316, filed on Dec. 12, 2007, that is a 371 of PCT/IB2006/052315, filed Jul. 7, 2006, which in turn claims the benefit of Brazilian patent applications PI0502934-1, filed Jul. 8, 2005 and MU8501548-2, filed Jul. 8, 2005, the contents of each of which are incorporated herein by reference.

FIELD OF THE INVENTION

The present invention relates to the field of industries producing powders as result or waste from a main production, being said powders usually rejected since no utility application is found, and more particularly the invention relates to a practical and innovative procedure and machine for producing laminates from particle aggregate and vegetal powder originated from industry of tobacco, tea leaves, aromatic herbs, etc., in which technology consists of laminating a mass of powders in order to reach a determined thickness, wherein after being subjected to drying it forms a new raw material for manufacturing cigarettes, tea, etc., among other products, thus making viable the reuse of raw material residues that would be naturally rejected since they do not have a granulometric dimension acceptable within specified standards, such that the present invention represents a substantial economy for the production processes of products with such industrial characteristics.

For the purposes of this description, the term "powder" or "powdered" must be considered as a material as powder itself, particles, granules, pieces, etc., of different granulometries.

BACKGROUND OF THE INVENTION

It is well known that industries related to products such as tobacco, tea and mate herb, that processing such raw materials, e. g., its cutting, milling, etc., leave as secondary result a critical quantity of material as particles or powders that, due to their granulometry, do not find useful application.

Industries producing products for consumption of vegetal base and have the use of these products as a leaf of the vegetal, while processing the leave itself, for many times causes the break thereof, resulting in mentioned powder production, which mostly does not have industrial application. As a consequence, this material is often destroyed, burnt or simply discarded as residue, incurring in economic and even environmental losses.

There have been attempts or recycle these discard materials by reinserting them into industrial production circuit, as masses generally plain, but the machines employed resulted in the complex combination of costly and inefficient apparatuses. Besides, obtained products lack required uniformity to re-cut and recycle the reconstituted in similar shape to the original leave for consumption. Among many failures, reconstituted masses or products have lumpy shapes, without cohesion, etc.

Due to the current state of the art there is a need to count on means to reuse the powder material secondarily produced in some industries such as tobacco industries, and which allows such powders to be reconstituted and reintegrated to the production line of said type of industry.

SUMMARY OF THE INVENTION

It is, therefore, an objective of the present invention to provide a procedure for reconstituting powders of vegetal origin, such as residual powders resulting from the industry of tobacco, mate herb, tea or similar, wherein said powders are usually rejected for their lack of utility due to its powdered characteristic, and wherein the procedure comprises the steps of:

- acquisition of said vegetal powder;
- mixture of said vegetal powder with an agglutinant compound and water, resulting in a vegetal powder substrate;
- laminating said substrate of vegetal powder to obtain a pellicle of desired thickness;
- drying said pellicle, and
- fragmentation (cutting) of said pellicle to obtain a product as fragments of desired size.

It is also another objective of the present invention to provide a procedure with the minimum number possible of steps, conveniently developed and conceived to allow it to perform its functions with efficiency and quality, showing outstanding practicality and versatility, incorporating distinct qualities, wherein the industrial process developed for the application of the art is simple in implementation, therefore being of easy execution, with which excellent practical and functional results are obtained, incorporating an innovative lamination conception.

It is a further objective of the present invention to provide a machine for reconstituting powders of vegetal origin, such as residual powders resulting from the industry of tobacco, mate herb, tea and similar, wherein these powders are mixed with agglutinants to form a vegetal mass that will be laminated, said machine comprising:

- a set of laminating rolls presenting a feeding funnel for the input of said vegetal mass;
- at least one conveyor placed in the output of the laminating rolls, to receive the discharge of said vegetal mass as a pellicle, and
- a thermal chamber in which at least one conveyor circulates, taking said vegetal mass as a pellicle for drying.

It is also a further objective of the present invention to provide a procedure and a machine conceived with an intelligent and original constructive arrangement with the objective of producing the lamination of vegetal substrates, such as vegetal powders and milled stems, whose granulometry is insufficient for said material to be employed in producing products comprising it, such as cigarettes, tea and flavored vegetal substrates, allowing said procedure and machine of the invention to reconstitute these powders and milled materials resulted as waste from mentioned industries.

It is also another objective of the present invention to provide a procedure and a machine for laminating and drying aggregates of powder and vegetal particulates, with low costs for industrial execution, aggregating requisites of robustness, safety, reliability and economy, reassuring its utilitarian application, providing the industrial consumer of such input with additional freedom and option of choice in analogous market, offering a number of productive possibilities and benefits, converting itself in a specific product of great expectation for this sector.

BRIEF DESCRIPTION OF THE DRAWINGS

For better clarity and comprehension of the objective of the present invention, it was depicted in several figures, wherein the invention was represented in one of preferred forms of realization, for exemplary purposes, wherein.

DETAILED DESCRIPTION OF THE INVENTION

Figure 2:
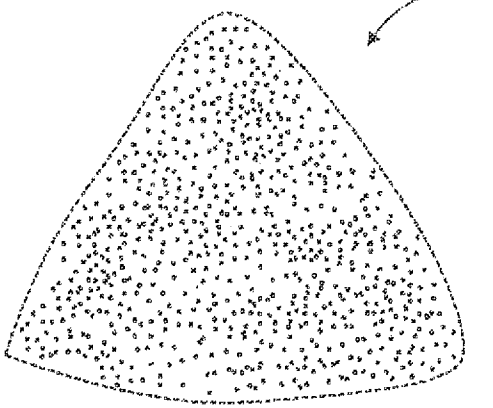
FIG. 2 shows a view of a hypothetic residual vegetal material (2) being presented as vegetal powder (4)
Figure 1:
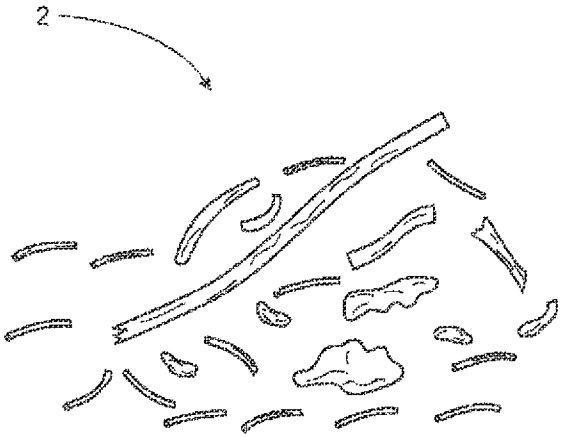
FIG. 1 shows a view of a hypothetical residual vegetal material, evidencing caules, stems and particles with several granulometries that will be processed.
Figure 4:
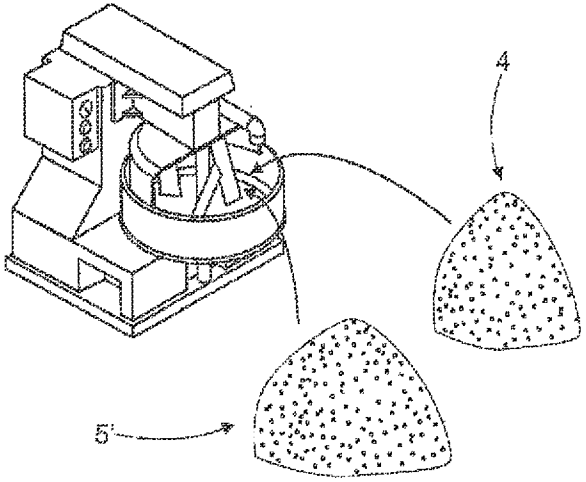
FIG. 4 shows an upper frontal view of an industrial shaker, evidencing the reception of the vegetal powder and agglutinant compound.
Figure 3:
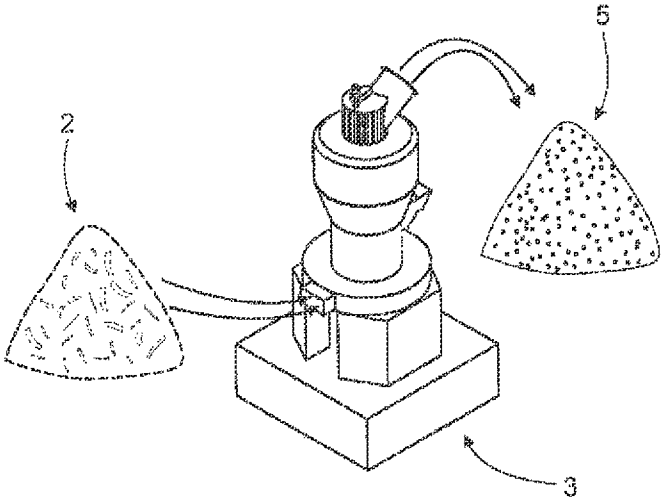
FIG. 3 shows an upper frontal view of a mill of pendular rolls which transforms the hypothetical residual vegetal material in vegetal powder, after milling.
Figure 6:
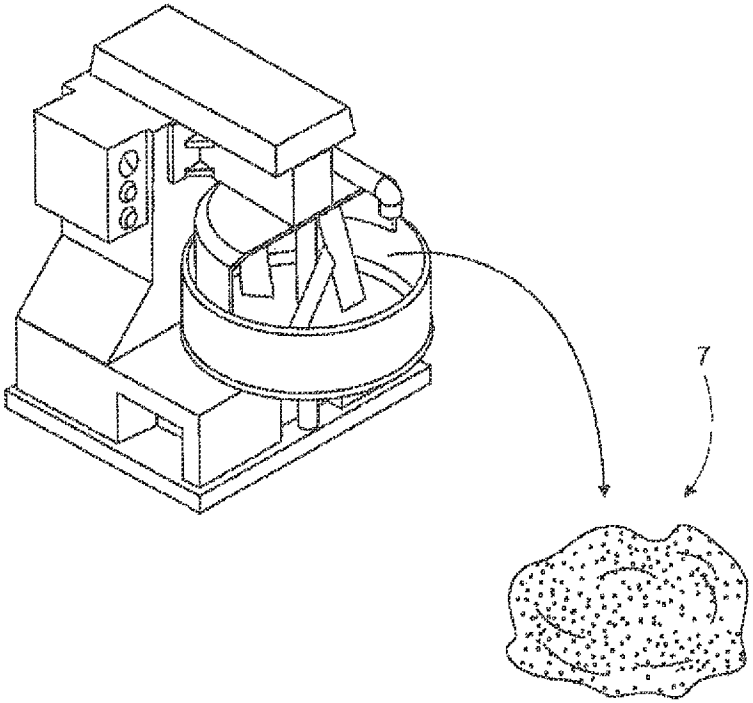
FIG. 6 shows an upper frontal view of the vegetal powder substrate processed by the industrial shaker.
Figure 5:
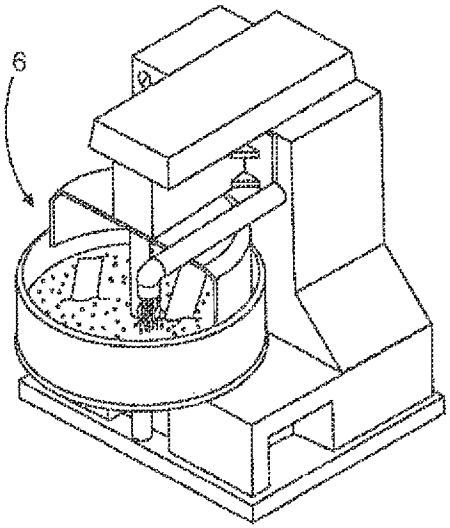
FIG. 5 shows an upper frontal view of an industrial shaker, processing the mixture of vegetal powder with the agglutinant compound.
Figure 7:
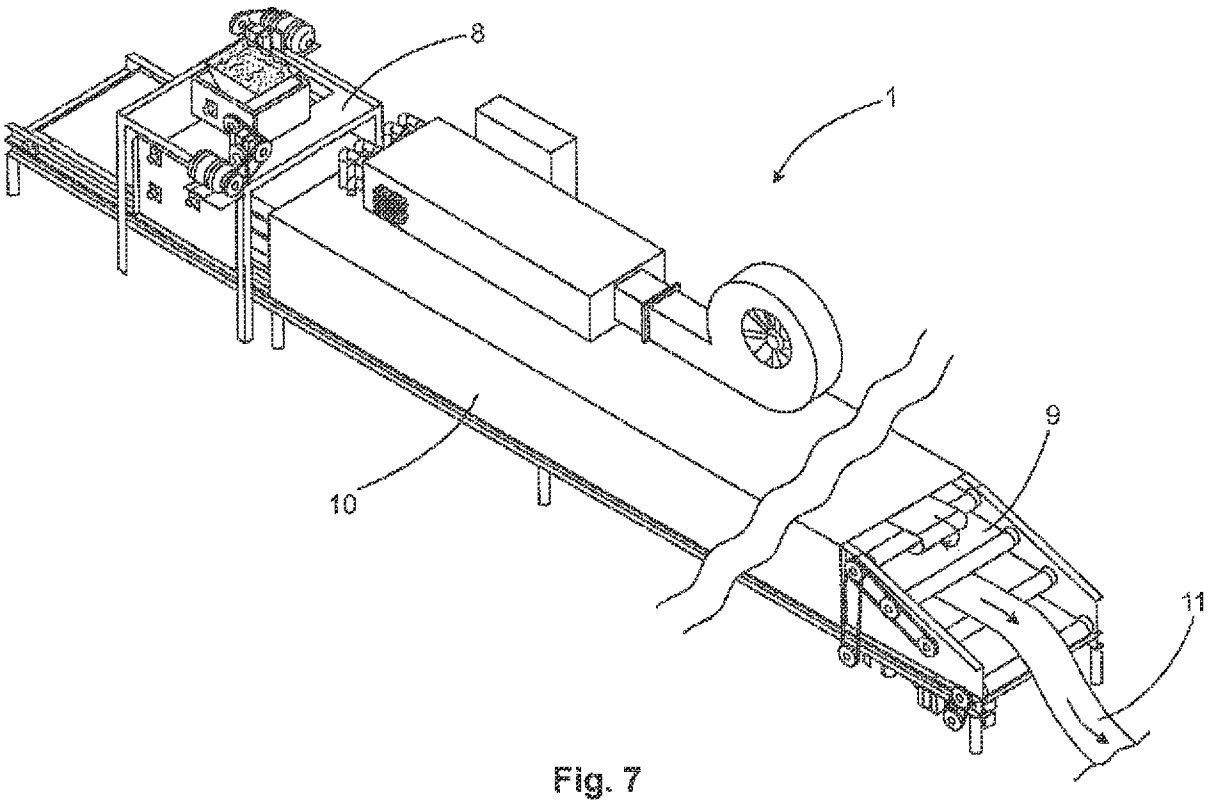
FIG. 7 shows an upper posterior view of the machinery according to the invention for reconstituting powders of vegetal origin, evidencing the production of the vegetal powder laminate, wherein steps and parts of the industrial process for reconstituting powders of vegetal origin by lamination process (1), roll laminator (8), conveyor (9), thermal chamber (10) and pellicle of vegetal material (11) can be seen.
Figure 8:
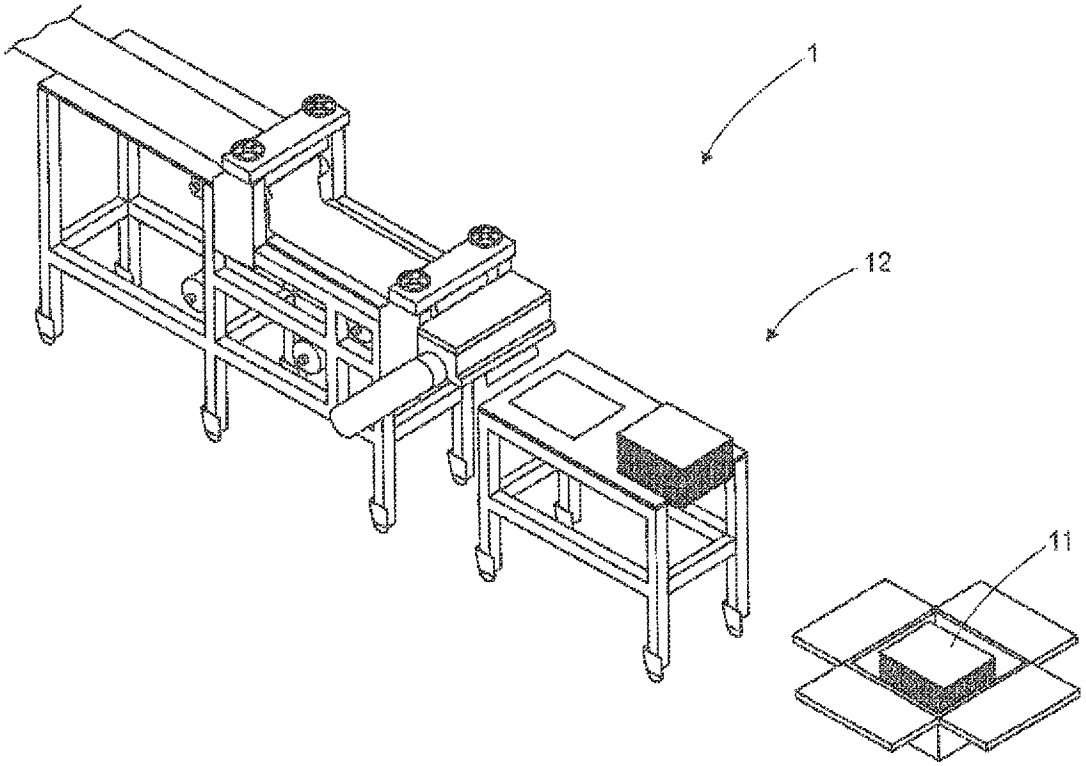
FIG. 8 shows an upper frontal view of the cutting and packaging section of the vegetal powder laminate, wherein the industrial process for reconstituting powders of vegetal origin by lamination process (1), pellicle of vegetal material (11) and cutting and packaging section (12) are schematized.
Figure 9:
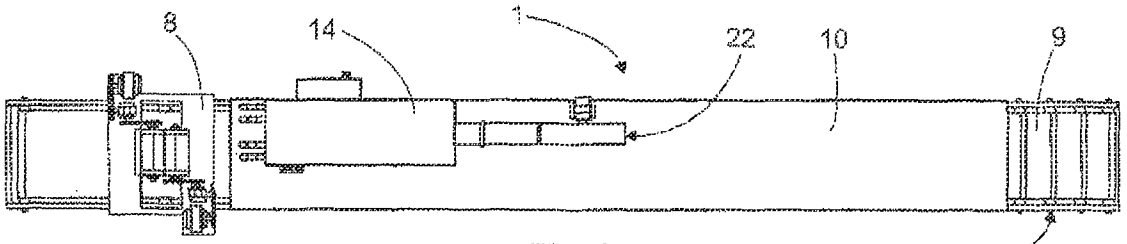
FIG. 9 shows a top view of the machine of the invention for reconstituting powders of vegetal origin by lamination process, wherein the machine for reconstituting powders of vegetal origin by lamination process (1), comprises a lamination device (8), a posterior drag roll device (13), a hot air insufflating system (14), a thermal chamber (10) and at least one conveyor (9)
Figure 10:
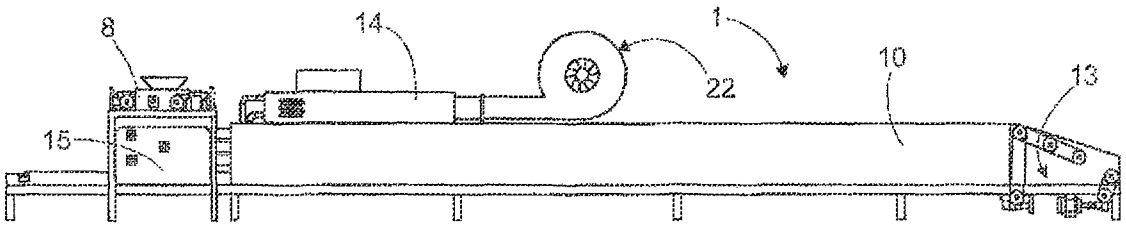
FIG. 10 shows a view of the right side of the machine for reconstituting powders of vegetal origin by lamination process.
Figure 11:
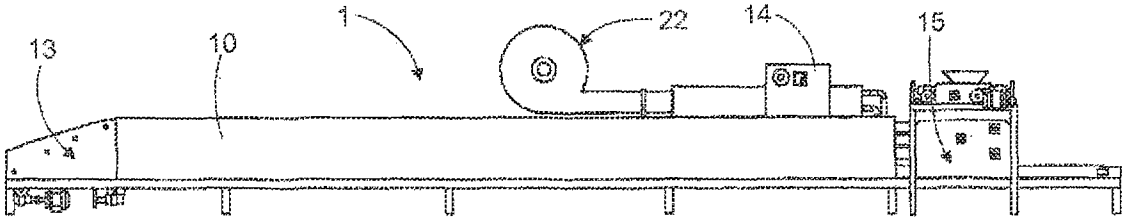
FIG. 11 shows a view of the left side of the machine for reconstituting powders of vegetal origin by lamination process.
Figure 13:
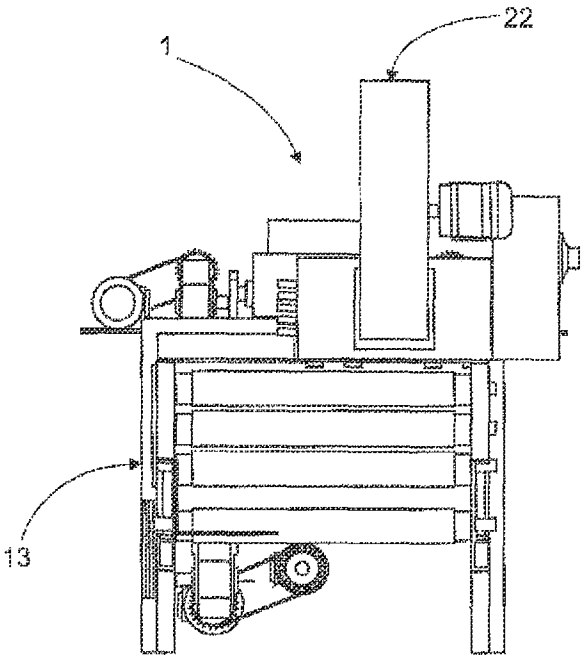
FIG. 13 shows a posterior view of the machine for reconstituting powders of vegetal origin by lamination process.
Figure 12:
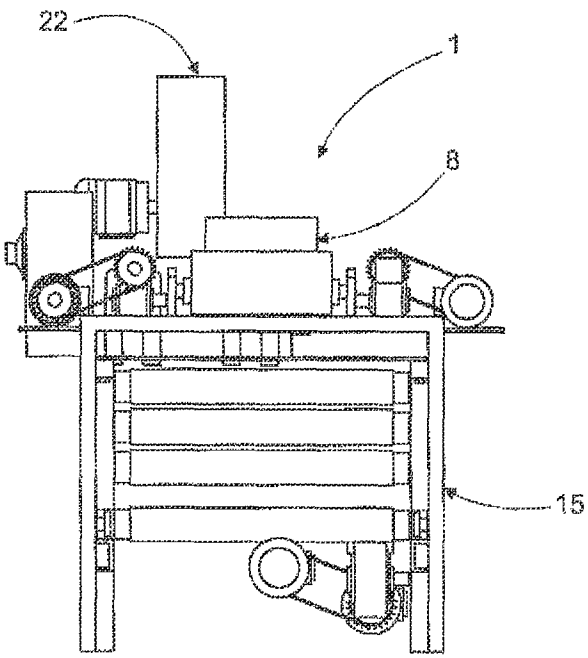
FIG. 12 shows a frontal view of the machine for reconstituting powders of vegetal origin by lamination process.
Figure 14:
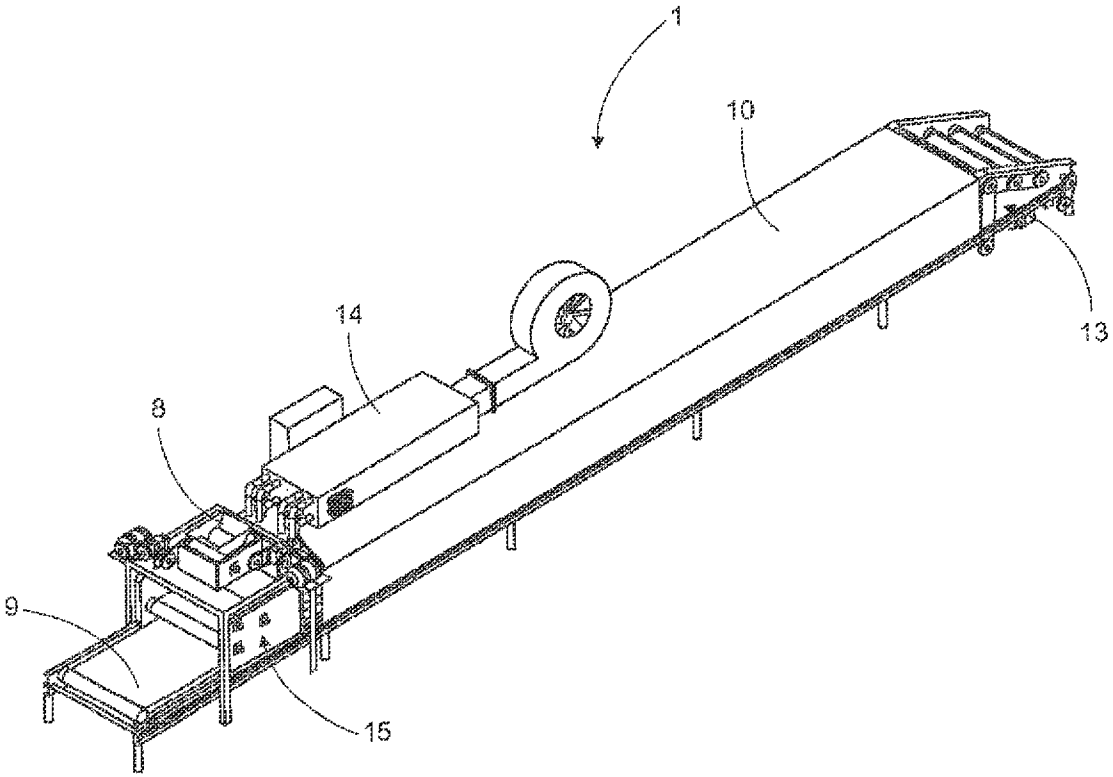
FIG. 14 shows an upper frontal right view of the machine for reconstituting powders of vegetal origin by lamination process.
Figure 15:
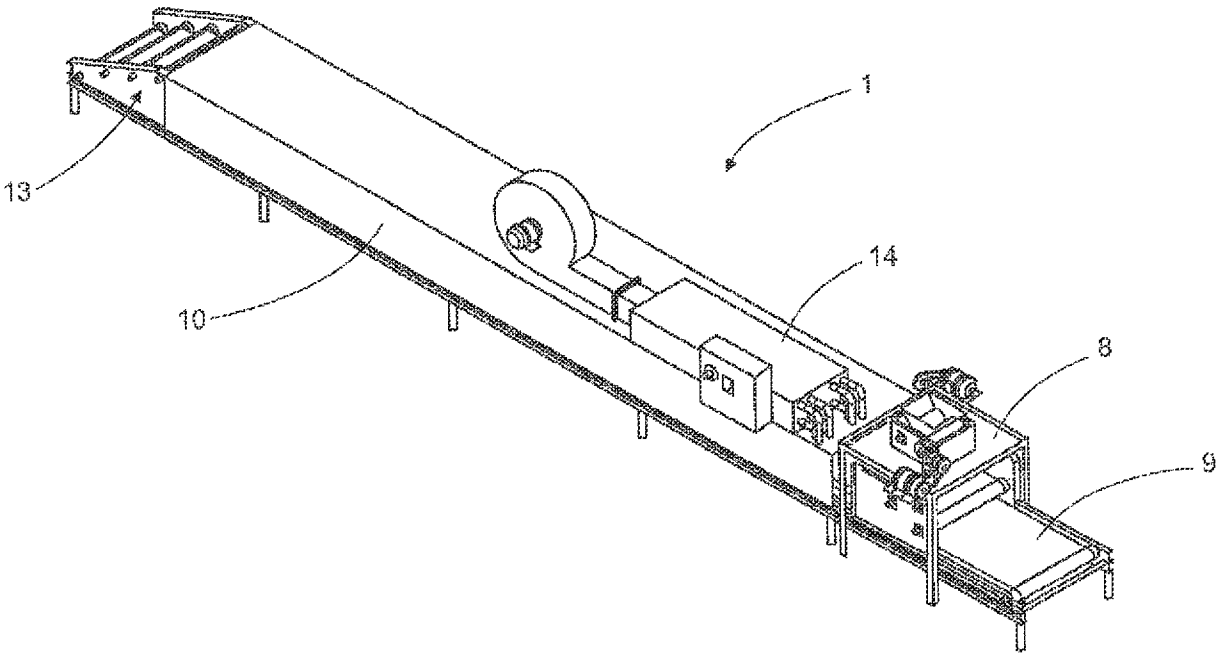
FIG. 15 shows an upper frontal left view of the machine for reconstituting powders of vegetal origin by lamination process.
Figure 16:
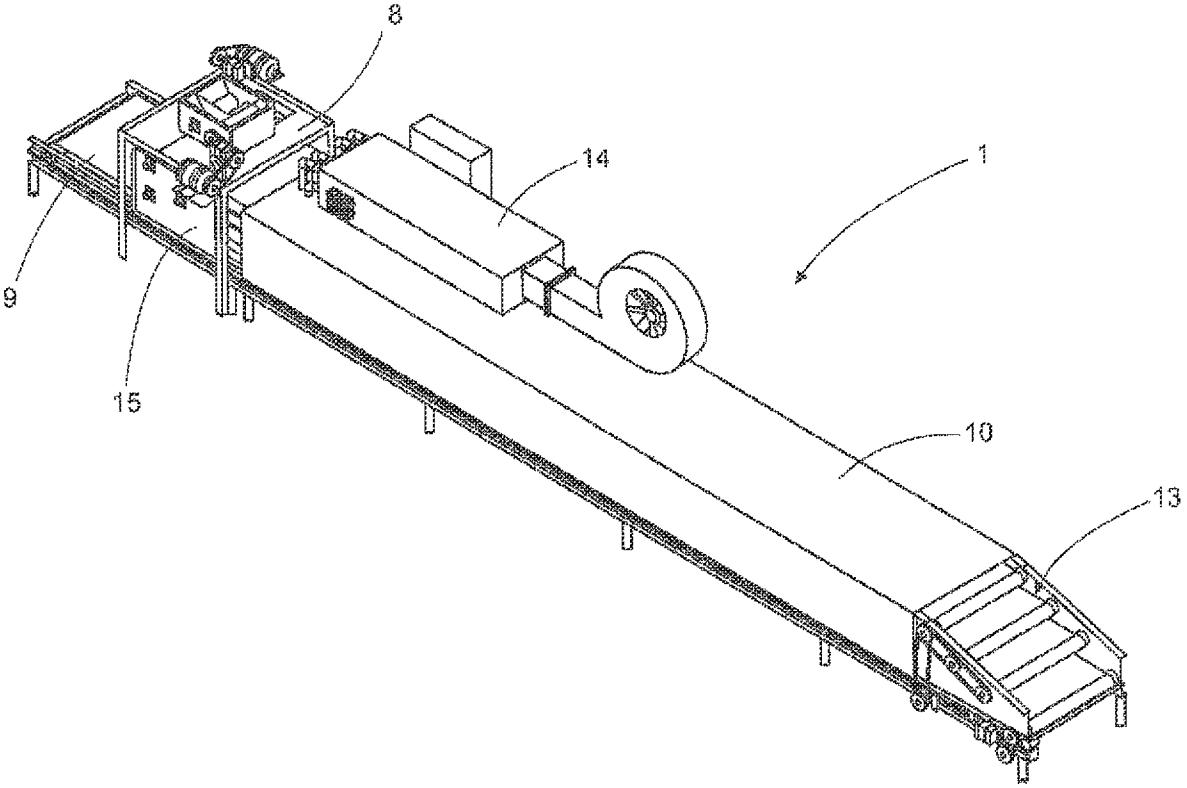
FIG. 16 shows an upper posterior view of the machine for reconstituting powders of vegetal origin by lamination process.
Figure 17:
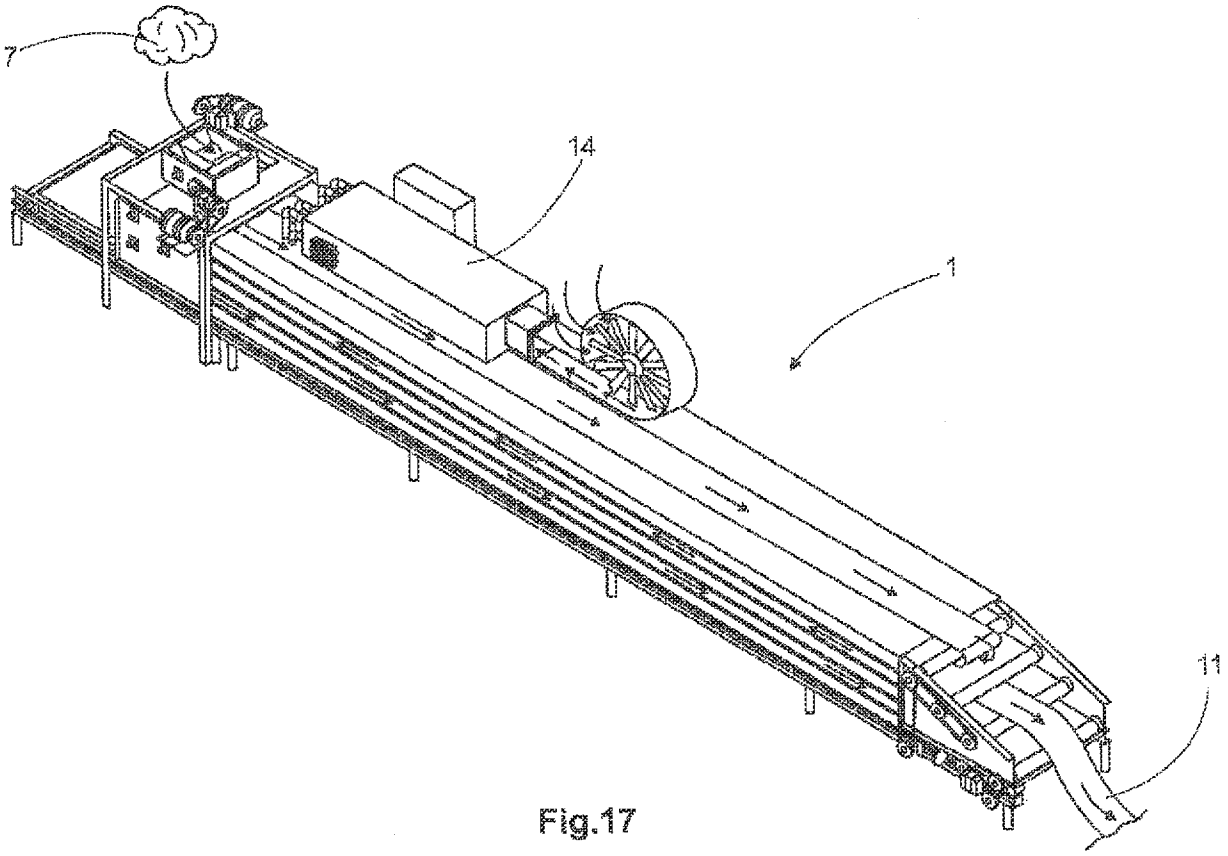
FIG. 17 shows an upper posterior view of the machine for reconstituting powders of vegetal origin by lamination process, evidencing its functioning.
Figure 18:
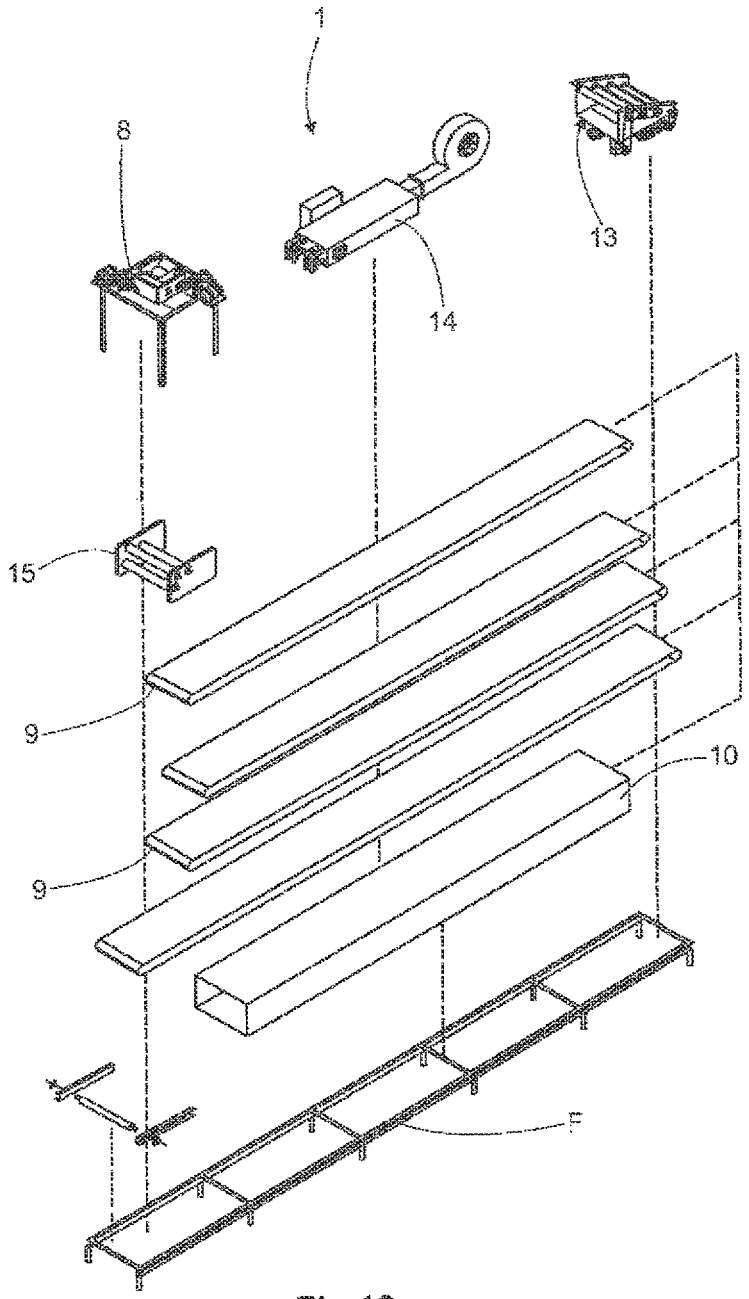
FIG. 18 shows an exploded upper frontal view of the machine for reconstituting powders of vegetal origin by lamination process, wherein a machine for reconstituting powders of vegetal origin by lamination process (1), a lamination device (8), a frontal drag roll device (15), a posterior drag roll device (13), the hot air insufflating system (14), a thermal chamber (10) and a conveyor (9) can be seen.
Figure 21:
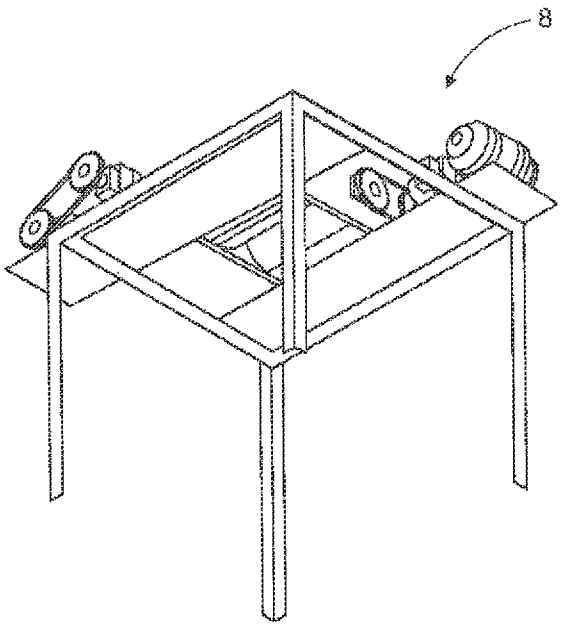
FIG. 21 shows a lower frontal view of the lamination device.
Figure 20:
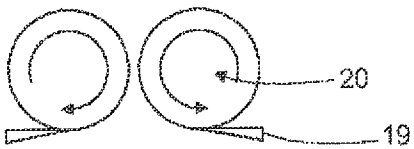
FIG. 20 shows a side view of the lamination rolls, evidencing the scrape knives (19) of the aggregated laminated material.
Figure 19:
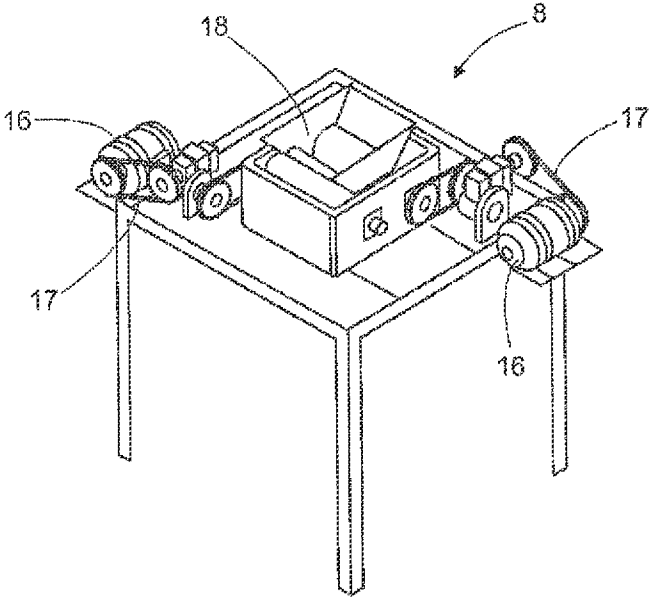
FIG. 19 shows an upper frontal view of the lamination device, wherein a lamination device (8), an electrical motor (16), a chain system (17) and a material feeding system (18) can be seen.
Figure 22:
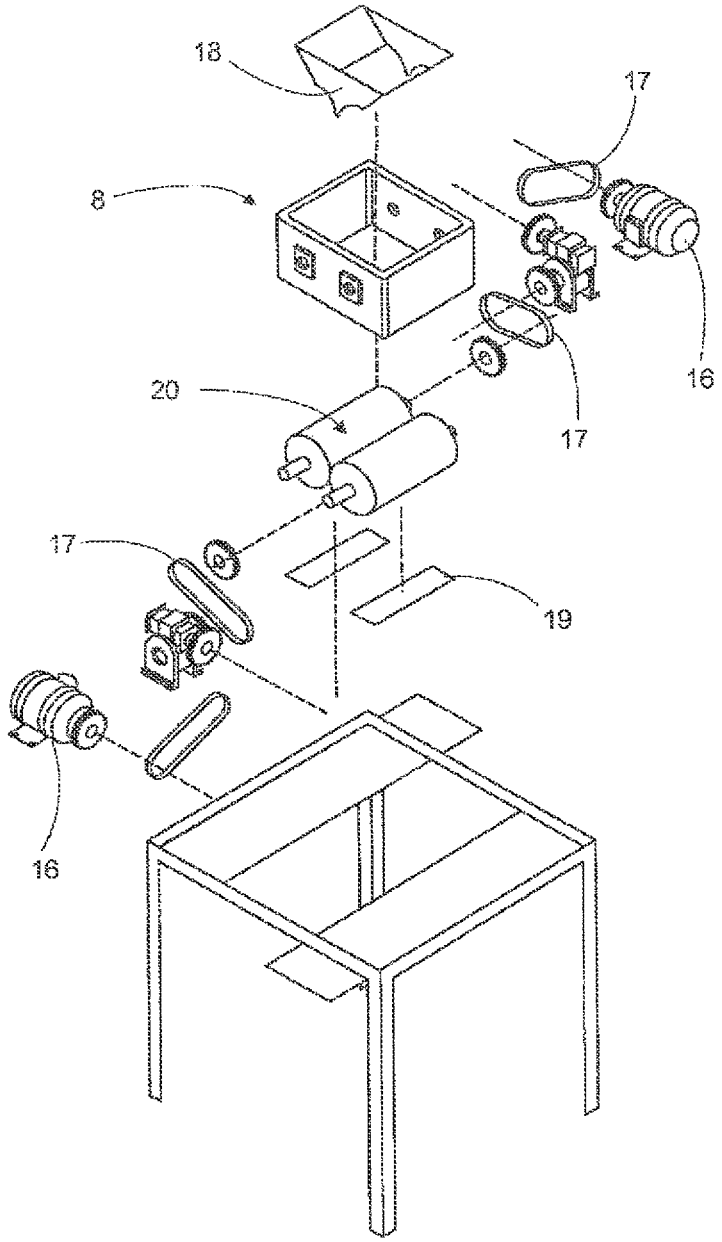
FIG. 22 shows an exploded upper frontal view of the lamination device, wherein the lamination device (8), the cylindrical pressing rolls (20), the electrical motor (16), the chain system (17) and the material feeding system (18) can be seen.
Figure 24:
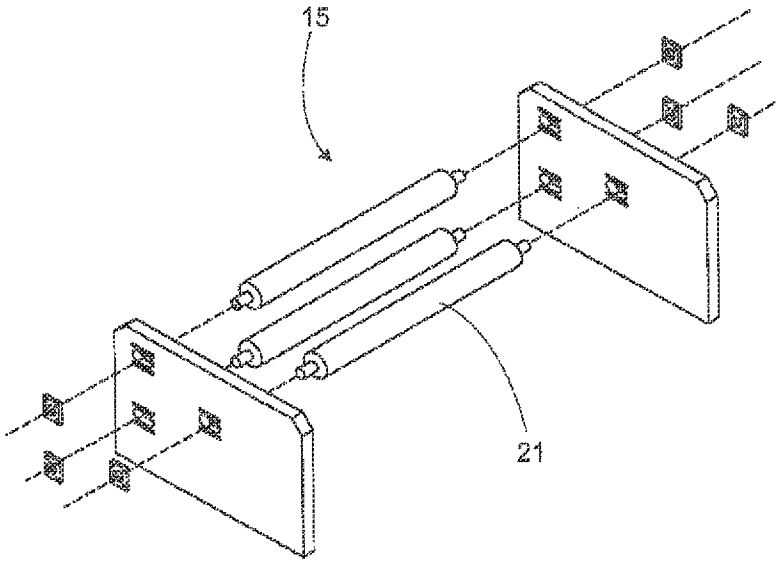
FIG. 24 shows an exploded upper frontal view of the frontal drag roll device of the conveyor, wherein the frontal drag roll device (15) and the conveying rolls (21) can be seen.
Figure 23:
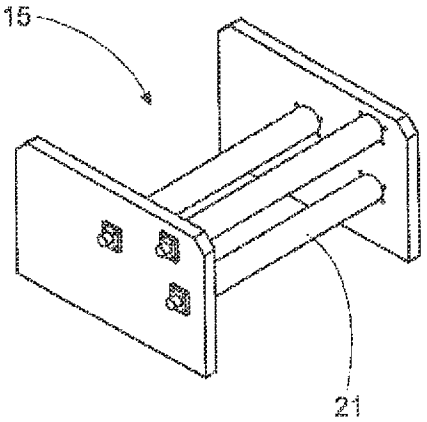
FIG. 23 shows an upper frontal view of the frontal drag roll device of the conveyor.
Figure 25:
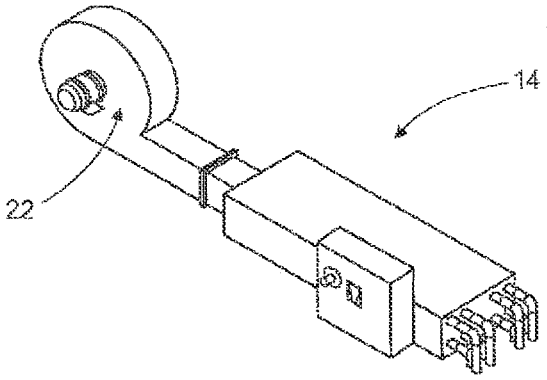
FIG. 25 shows an upper frontal view of the hot air insufflating system.
Figure 26:
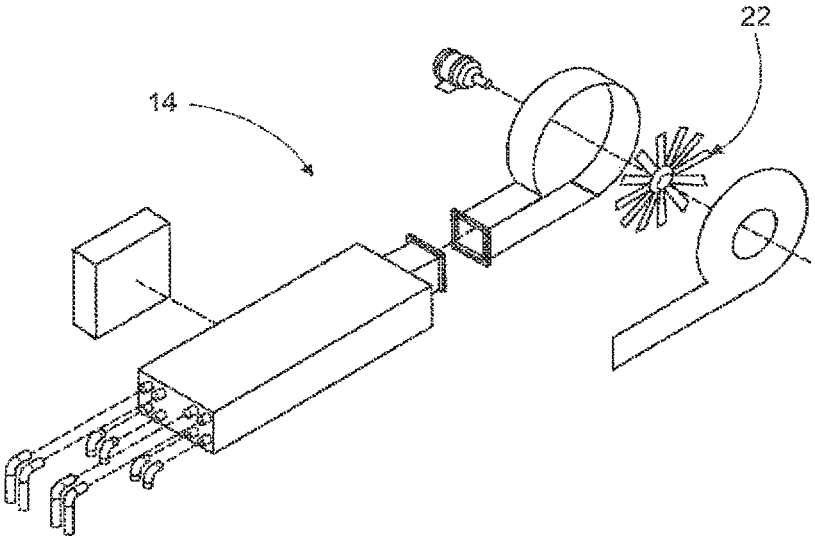
FIG. 26 shows an exploded upper frontal view of the hot air insufflating system, wherein hot air insufflating system (14) and a rotor with paddles (22) can be seen.
Figure 27:
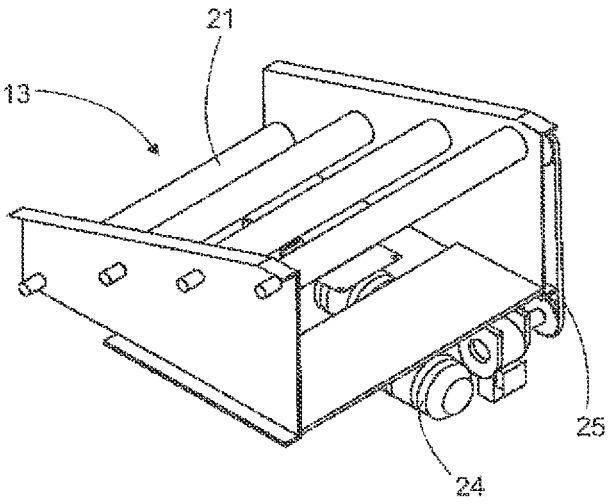
FIG. 27 shows an upper posterior left view of the posterior drag roll device of the conveyor.
Figure 28:
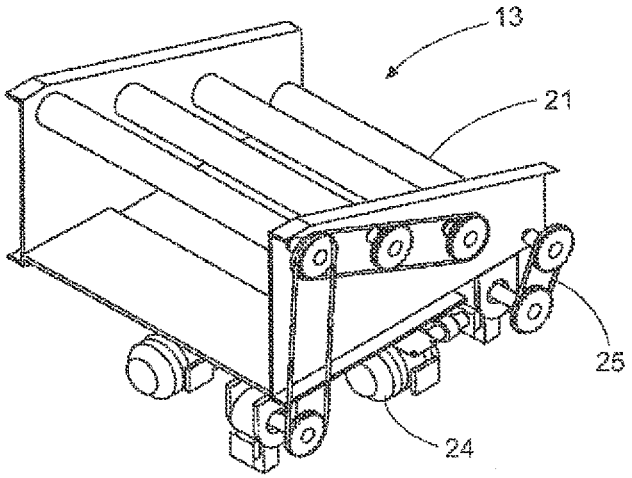
FIG. 28 shows an upper posterior right view of the posterior drag roll device of the conveyor.
Figure 29:
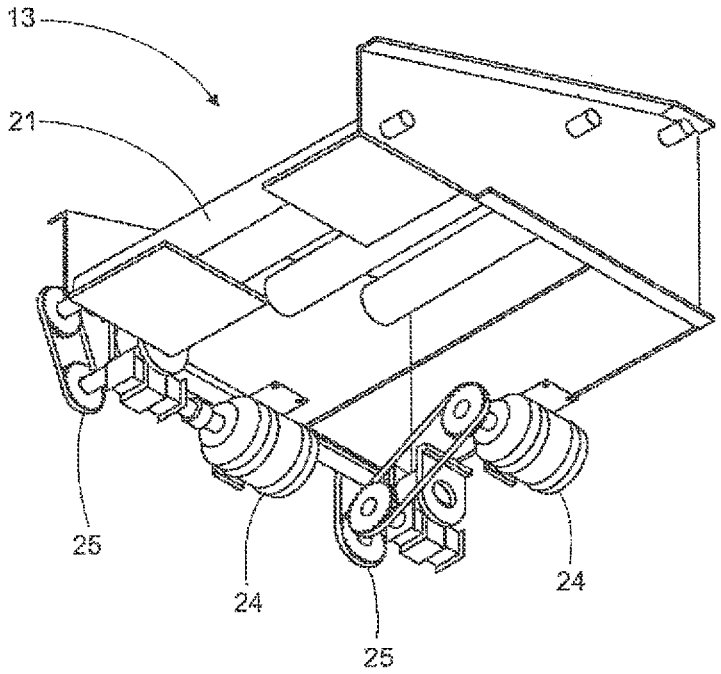
FIG. 29 shows a lower frontal left view of the posterior drag roll device of the conveyor.
Figure 30:
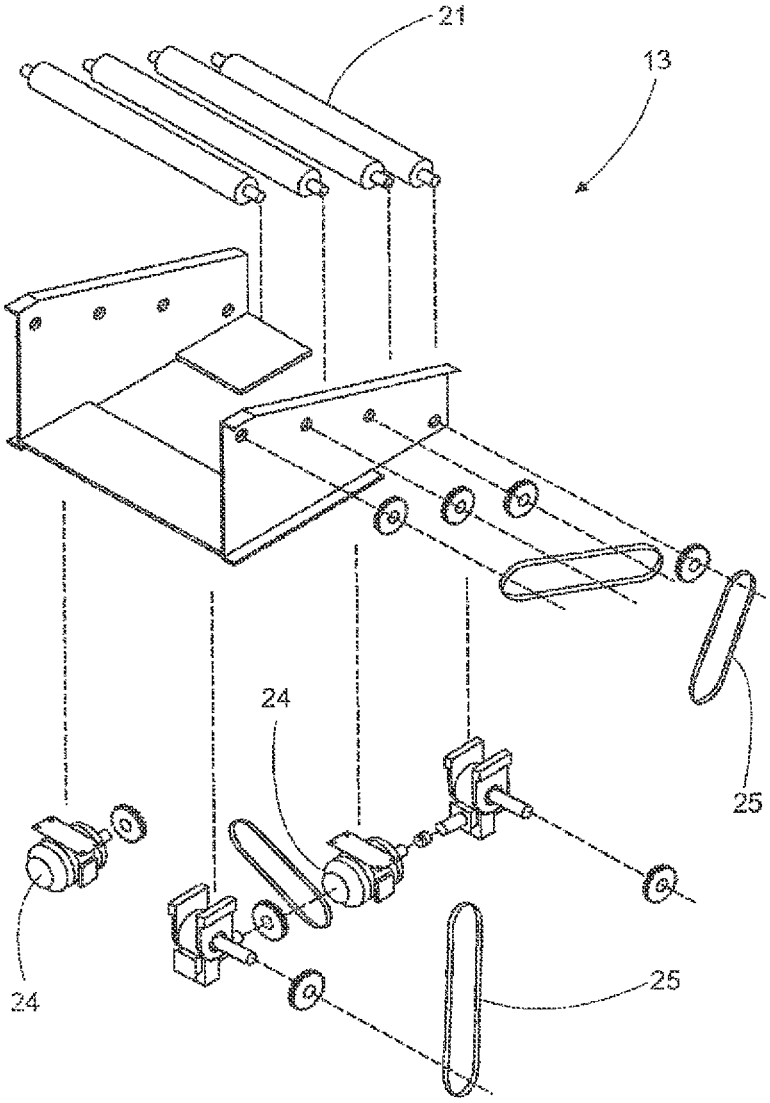
FIG. 30 shows an exploded upper posterior view of the posterior drag roll device of the conveyor, wherein the posterior drag roll device (13) with the electrical motors (24), the set of chains (25) and the conveyors (21) can be seen.

With reference to the figures, it is noticed that the invention comprises, in one of its aspects, an industrial process for reconstituting powders of vegetal origin by lamination process (1), a residual vegetal material (2), such as pieces, powders of different granulometries, stalks and stems that would be naturally discarded, undergoes a milling process (3) to be reduced to powder and that may be mixed to other residues as a vegetal powder (4), forming a single material of vegetal powder (5) with appropriate granulometry.

The industrial process of the invention allows the transformation of vegetal powder in laminated leaves so as to return to the production cycle, wherein all the vegetal material to be used may undergo a milling process, with final granulometry that may range from 10 to 200 MESH, depending on the level of desired visual homogeneity for the final film. The mill to be used may be a hammer mill.

The material of vegetal powder (5) is mixed with an agglutinant compound (6) and water resulting in the formation of a vegetal powder substrate (7), which is conduced to the next step of the lamination process. In order to prepare the mass to be laminated, the vegetal powder to be reconstituted and the agglutinant compound are added to a mixer, in a ratio of 100 Kg of vegetal powder to be laminated with 5-50 Kg of agglutinant compound, and then mix it for about 10 minutes. Next, about 5-100 Kg water is added to the mixer, undergoing a mixture process for about 10 more minutes, wherein the mass, after being mixed, must be of easy modeling, observing that the type of mixer to be used must ensure total homogeneity of the final mass, it should be noticed that the industrial mixers of "ribbon blender" type may be used for such purposes.

The process of the invention also foresees the production of vegetal films with aroma and taste corrected, improved, highlighted or modified, by adding specific flavors and additives to the agglutinant compound, which makes this inclusion of flavors and additives much more effective, since with such procedure they will be more firmly attached to the matrix of the film to be generated, when compared with the type of application that is normally in use in the industry, i. e., aspersion over the leaves. Thus, the specific flavors and additives would be added to the vegetal powder directly through the agglutinant compound, as previously described.

The vegetal powder substrate (7) is inserted in a roll laminator (8), which will be referred to later, so as to be laminated and have the desired or specified thickness reached. Thus, the prepared mass is placed in the feeder of the set of rolls with the spacing between rolls from 0.05 to 2.5 mm and the speed of the rolls from 1 to 100 RPM, where the passage through the system of rolls a pellicle is formed, then going to the first conveyor, being taken into the oven with temperature from 100 to 400° C. More precisely, a pellicle or film arranged over a conveyor (9) is conduced to the interior of a thermal chamber (10) that will perform the drying of the material until it reaches the required moisture, already as a pellicle of vegetal material (11). The final moisture of the material falls to 8-20%, wherein the drying time shall depend on thickness of the film, the type of starting material (vegetal powder), the initial moisture of the starting material (vegetal powder), of the quantity of water added to the mass, the temperature of the oven, the speed of the rolls and consequently on the speed of the conveyors, the number of conveyors and the moisture desired for the final material.

A pellicle of vegetal material (11) after drying may resemble a piece of fabric or paper and it may be cut and packaged (12) or again transformed into granules and fragments so as to be used as raw material for by-products. During all the formation process of the pellicle of vegetal material (11), there is control of the passage speed of the material through the lamination rolls and through the thermal chamber, as well as of the temperature and moisture parameters required by the procedure. As previously explained, the pellicle of vegetal material (11) may receive the addition of flavoring products or mixtures of several differentiated vegetal powders, in the mixture phase of the vegetal powder substrate (7).

In the object of the present patent the following items were technically addressed; industrial process for reconstituting powders of vegetal origin by lamination process (1), residual vegetal material (2), milling process (3), residues of vegetal powder (4), material of vegetal powder (5), agglutinant compound (6), vegetal powder substrate (7), roll laminator (8), conveyor (9), thermal chamber (10), pellicle of vegetal material (11), cutting and packaging section (12).

The way the material will be made available for industry is only an operational procedure and the use of the material as a continuous film or any other form, provides the same results, maybe superior, in relation to the properties of the original material. Therefore, the pellicle obtained may be used directly by the industry as a film, or then undergo a cutting process with the objective of obtaining material of appropriate size and shape, wherein the final material to be made available for industries may be as a continuous film, as pieces of several sizes, shredded, etc.

The present invention also relates to an equipment or machine or installation, in which the procedure previously described or other procedures can be performed, for reconstituting powders of vegetal origin, through the formation of pellicles thereof, for use in tobacco and food industries. More specifically, the equipment is designed for producing pellicles of tobacco, cinnamon, clove, mate herb and other vegetal products as a powder, allowing the use of a residue that is normally burnt or discarded by industries using this material as a leaf or another non-powdered shape different from powder, wherein the thickness of the leaf may range from 0.05 to 2.50 mm, with moisture from 8 to 20% and variable mechanic resistance.

As already explained about the procedure, the tobacco pellicle may be formed from tobacco powders of diverse origin, such as the ones obtained as by-products of cigarette industries, tobacco processing plants, tobacco processing industries, etc., wherein powders from several types of tobacco can be used in the process, such as stems, "scraps", "winnovers" or "winnowings", tobacco residues in general, tobacco pellicles of any type/class, etc. If the product to be laminated is not a powder, or even if a film of uniform appearance/thickness is desired, all the vegetal material to be used must undergo milling process, with final granulometry that may range from 10 to 200 MESH, depending on the desired visual homogeneity for the final film.

In conformity with the depicted in the figures, the equipment or machine of the present invention is based on the lamination of vegetal powders and granules and is used for reconstituting powders of vegetal origin. The lamination equipment (1), constructed over metallic structure (F), basically comprises a lamination device (8), a series of frontal (15) and posterior (13) drag rolls, a hot air insufflating system (14), an oven or thermal chamber (10) and at least one conveyor (9).

The lamination set (8) preferably comprises at least two cylindrical pressing rolls (20), preferably metallic, which rotate in opposite directions with speed control and which, as will be described later on, are assembled so as to be regulated in its position. The rolls (20) are actuated independently by two electrical motors (16) and a set of chains (17). Alternatively, the disposition in which two electrical motors (16) are directly coupled to the rolls (20) can be chosen, without the need of chains (17). The mass of aggregated material of vegetal powder (7) that is introduced in material feeding system or powder (18) is then passed through the rolls (20) to produce the pellicles of vegetal powder (11). The lamination device (8) incorporates under the cylindrical rolls (20) two scrape knives (19) of the rolls.

Before entering the vegetal mass (7) to be laminated in the laminating set, it must be mixed to the non-toxic agglutinant compound and water, forming a moldable mass, wherein the concentration of the agglutinant compound may range from 5 to 50% (mass/mass, regarding the mass of powder used).

In lamination, the vegetal mass is pressed between the rolls (20) to be shaped as a pellicle, sheet or film with thickness that may range from 0.05 to 2.5 mm, being said pellicle laminated in rolls with controlled speeds and intervals.

In the lamination set, the speeds of the rolls vary from 1 to 100 RPM, wherein each of the rolls forming the lamination set has independent speed, regarding the speed of the rolls ranging from 2 to 30 RPM, so that the mass being formed is laminated and results in a film with thickness between 0.05 and 2.50 mm, having practically the shape of a perfect blanket or carpet.

The lamination rolls (20) are preferably constituted of two metallic cylinders of variable diameter, with precision of 0.02 mm in diameter, totally linear and parallel. Both rolls are placed in the structure so that the oscillation variation, i. e., the longitudinal movement in the process for obtaining the pellicle, is up to 0.02 mm and must be completely parallel. The speeds of the rolls must vary so as to get a thin pellicle and of smooth and uniform aspect, without marks, holes or deformities, and to do so the speeds must be specific for each material, ranging according to a desired thickness, level of moisture and production speed.

The scrape knives of the leaves are placed in the bottom part of the rolls, with angles that may range from 0.0 to 45.0° regarding the tangent of the roll, rigorously sharpened with tips smaller than the smallest thickness of the film to be obtained, and with permanent contact pressure with the roll at any moment.

Figure 31:
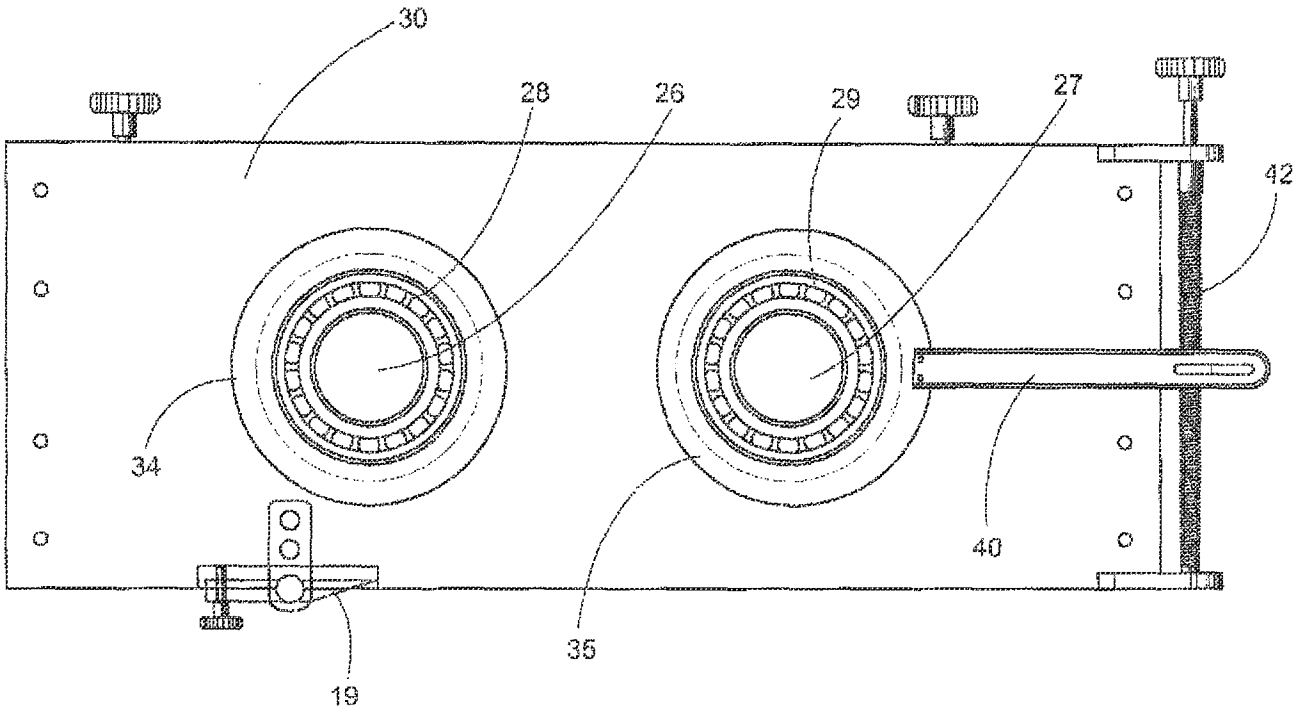
FIG. 31 shows a side view of the lamination set (8), wherein the rolls ends (20) and an assembly of a concentric axle for one of the rolls and of one exocentric axle for another roll can be seen.
Figure 32:
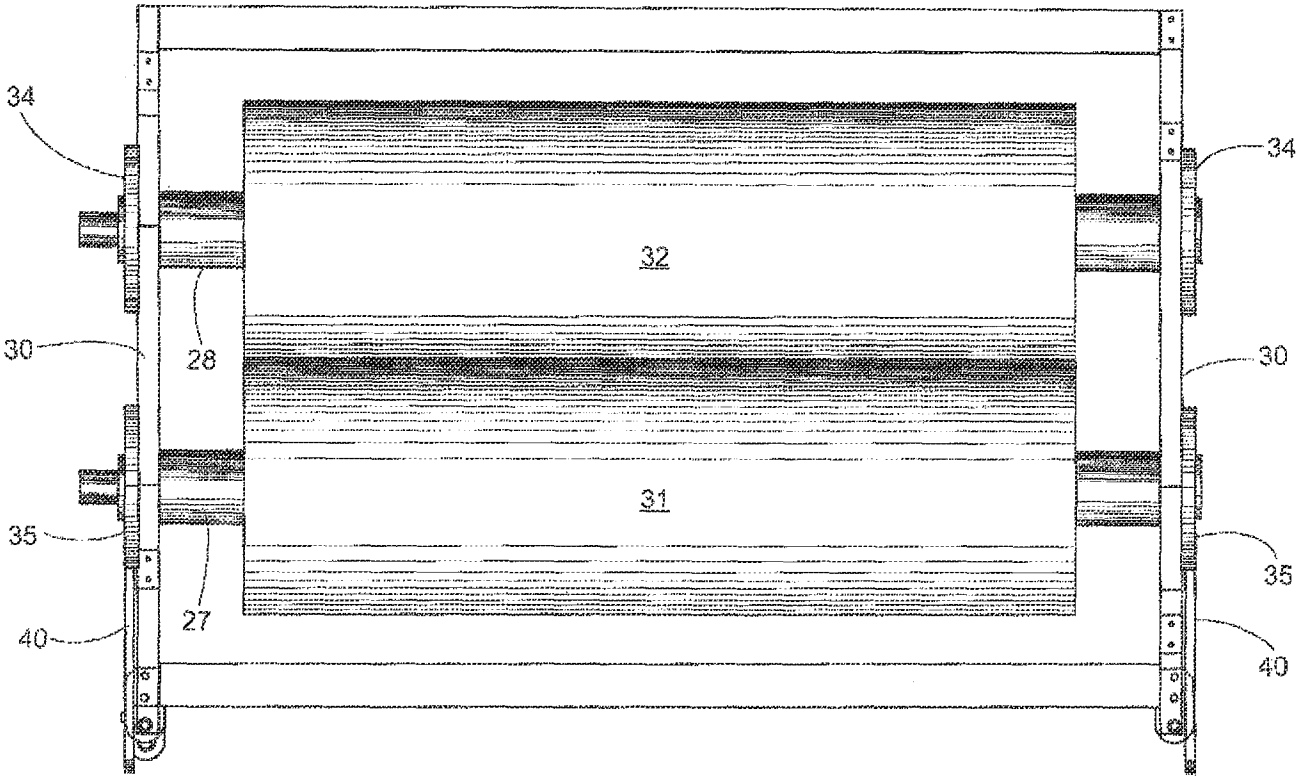
FIG. 32 shows a top view of the rolls (20)
Figure 33:
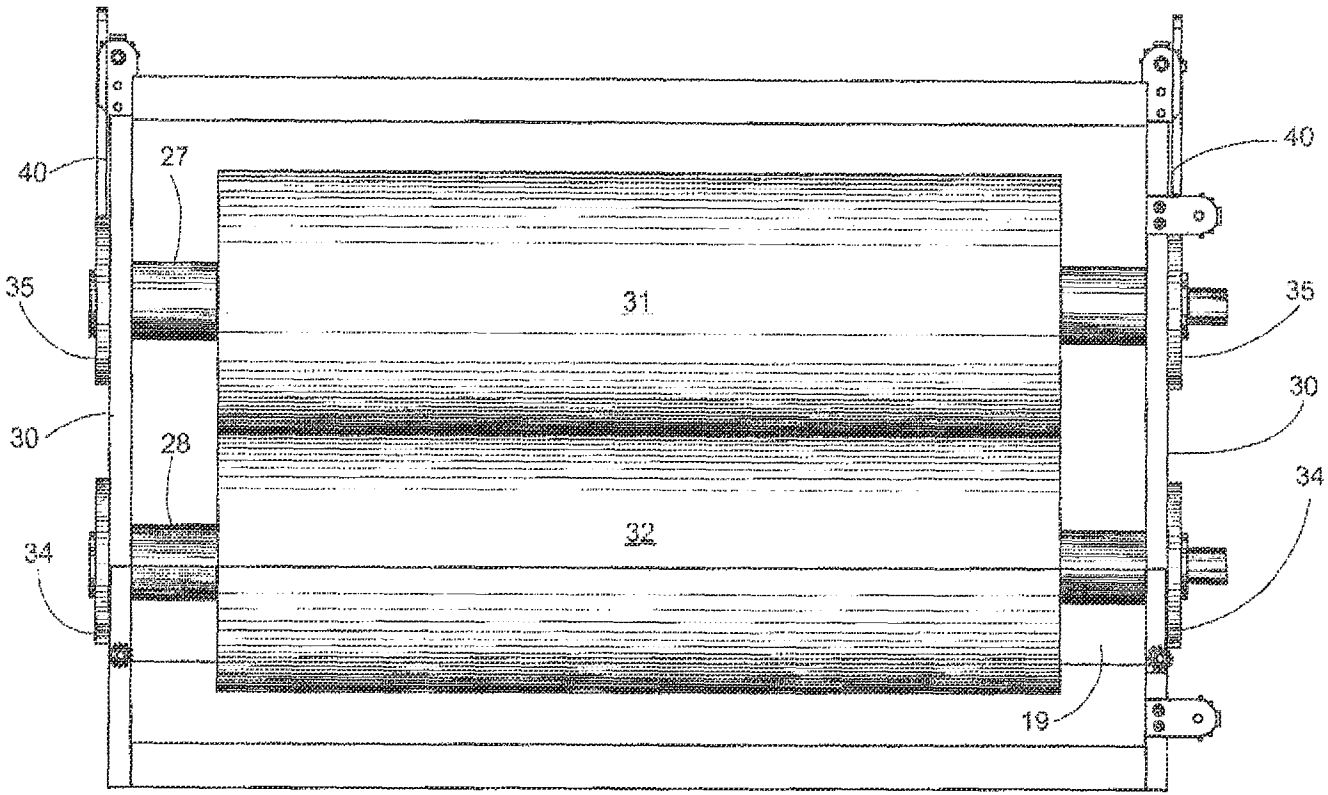
FIG. 33 shows a bottom view of the rolls (20), wherein the knife (19) for cleaning the corresponding roll can be seen.
Figure 34:
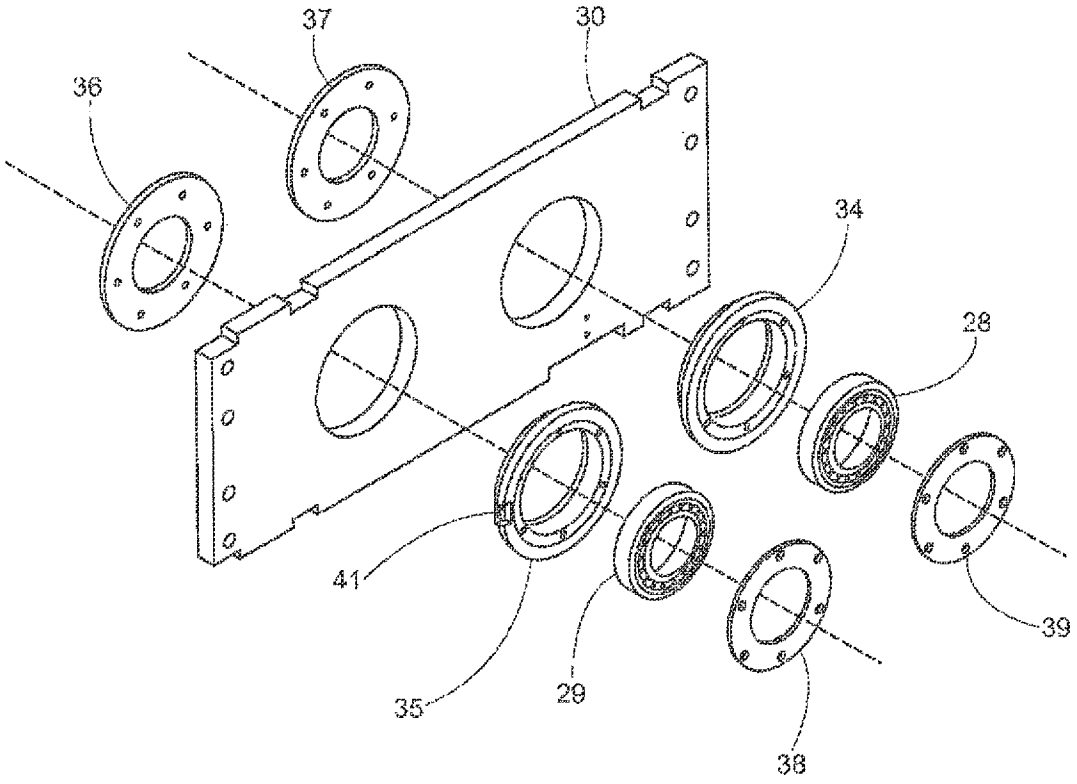
FIG. 34 shows a detailed view of the components interfering in the axle assembly of the rolls (20).

In FIGS. 31-34 the assembly of the rolls (20) is depicted in detail. Preferably, the set (8) is comprised of two laminating rolls (20), individually numbered as (31) and (32) in FIGS. 32 and 33, whose ends (26) and (27) are assembled on corresponding bearings (28) and (29) installed on respective assembly plates 30) allowing both rolls (31) and (32) to turn in parallel. The axle ends of one the rolls or first roll (32) are assembled in its respective concentric flanges (34), better depicted in detail in FIG. 34, being installed inside the flanges in its respective bearings (28). On the other hand, the ends of the axle of the other roll or second roll (31) are assembled in its respective exocentric flanges (35), with its corresponding bearings (29), being said flanges (34) and (35) assembled in parallel plates so that this exocentric flange (35) may turn in this assembly. The set of flanges is locked in the plates (30), e. g., through fastening covers (36), (37), (38) and (39).

According to the present invention, these exocentric flanges (35) are connected to a device of angular regulation comprising two arms (40), one in each side of the set, and each arm having an end connected to said exocentric flange (35), more particularly in a fixation pin (41) of the flange to firmly attached thereto. The opposite end of the arm (40) is connected to a regulating screw (42), so that when this screw turns in a desired direction, the arm goes up or down, causing the flange (35) to turn and approximate or deviate the second roll (31) in relation to the first roll (32) to vary the spacing between and, thus, to vary the thickness of the vegetal material pellicle (11). In FIGS. (31) and (33) more details of the knife assembly are shown (19) only for illustrative purposes.

Once the vegetal mass has passed through the rolls (20) and has the shape of pellicle, it falls on the conveyor (9) and is conduced to the interior of the oven or thermal chamber (10) whose interior contains a conveyor (9) moving in three or more passage cycles so that the vegetal powder laminate (11) produced by the lamination device (8) loses moisture, according to technical production criteria.

The conveyor (9) moves occupying all the internal extension of the thermal chamber (10) accomplishing three or more passage cycles, i. e., moving in zigzag, being dragged, supported and tracked by two drag roll devices, i. e., a frontal set (15) and a posterior set (13), which presents, respectively, three and four conveying rolls (21) each and whose motive power is attributed to an electrical motor (24) with rotation control allocated in the posterior roll device (13).

The conveying system, preferably of metallic material, is assembled inside an oven or thermal chamber (10), with capacity to establish an appropriate speed for the lamination set, wherein the formed film must fall on a first conveyor and enter the oven to undergo the drying process, wherein the speed of the conveyor must be regulated with the speed of the film in the set of rolls, according the material being processed, the quantity of agglutinant compound, the deviation of the rolls, the lamination speed, the moisture of the film and the desired thickness.

The oven or thermal chamber (10) is heated by the insertion of hot air from a hot air insufflating system (14), which has a rotor with paddles (22) providing forced ventilation of the heated air with controlled temperature and outflow. The oven used may be industrial, 1-50 m long, allowing to be heated from 100 to 400° C. The air, in desired temperature, must be injected in the oven. Alternatively, it can be used for heating the oven a system based in thermal blower, steam or any other device accomplishing such purpose. To remove internal moisture, so as to control the moisture of the final material, an air collection system with refrigeration may be coupled to the oven so as to recover part of the flavors lost in the drying process of the material, which may be then added again to the agglutinant compound, thus improving the quality of the film obtained.

When the film or pellicle is introduced into such oven, it undergoes a continuous drying process on all conveyors, being conduced through the oven (coming and going) and its numeric quantity inside the oven will vary according to the thickness of the film, the speed of the system of rolls, the drying temperature, the type of starting material and the initial moisture and the desired final moisture for the film, and it may even be constructed with a single larger conveyor and yet allowing the system to drag the final leaf in any of the ends, so as to avoid overheating of the leaf, thus losing the plastic characteristic of the material. Since the temperature of the oven may range from 100 to 400° C. and since the thickness of the final pellicle may range from 0.05 to 2.5 mm, it is then subjected to a drying process reducing the moisture of the film to 8-20%.

The way by which the material will be made available for industry is only the operational procedure and the use thereof may be a film, or to undergo a cutting process with the objective of obtaining material of appropriate size and shape, wherein the final material to be made available for industries may be a continuous film, in pieces of several sizes, shredded, etc. The cutter to be used in the process may be a system of rolls with knives or only one knife for final cutting, wherein during the feeding of the rolls there is also the possibility of using a segmented feeder, which would form smaller films.

Tests performed using tobacco powder discarded from the industry have shown the industrial and economic viability of the developed process, increased by the introduction of specific flavors and additives that correct, improve, highlight or modify flavor and taste of the initial material, which has attracted great attention from companies.

Once these specific flavors and additives developed through the process may be added along with the agglutinant system, product proved to be non-toxic, thus being more firmly attached to the film generated than if it was simply aspersed on the surface of the leaf, as in the usual addition processes thereof, thus providing organoleptic characteristics superior to those of the original product or even of applications of specific flavors and additives by usual application process, aspersion on the surface of the leaves.

It is the intention of the invention the use of the agglutinant compound for obtaining films from pellicles of tobacco, coffee, cinnamon, clove, mate herb and other vegetal products as powders, mixtures thereof products when above mentioned, or any other film of interest for tobacco and food industries. The defended modalities of the present technology may imply that the researches of the applicant allowed the verifying that the films may be obtained from tobacco powder, mate herb powder, clove powder, licorice powder, catuaba powder, cinnamon powder, mixtures thereof, and any other powder that may be used in manufacturing vegetal films, flavored, reconstituted, or modified.

As above mentioned, the modality of the invention foresees the addition of specific flavors and additives to correct, improve, highlight or modify desired characteristics and it must be clear that the application of the equipment to prepare laminated films from powders of vegetal origin aims to reuse such material that, according to the previous art, would be discarded, causing critical economic and environmental impacts, besides producing a gamma of specific flavors and additives of great application and industrial interest.

The advantage of such agglutinant compound is that the final manufacturer neither needs to dispose the powder originated in its processing, nor to increase the use of powder to manufacture its product, diminishing the quantity of residues, since it can also correct, improve, highlight or modify the flavor and taste of the final material to be obtained, with advantages for its process.

In order to verify the suitability of the agglutinant compound to the process, laboratorial equipment with production capacity of 10 kilograms/hour was produced, so that tests could be performed in industries using this material, wherein afterwards the equipment was improved for a production of 30 kilograms/hour for producing material to be used by clients interested in equipment and processing of reconstituted leaves.

Through this process may be obtained the following powder pellicles: tobacco pellicle, catuaba pellicle, mate herb pellicle, clove pellicle, cocoa pellicle, tobacco pellicle with addition of flavors or additives specific aiming to correct, improve, highlight or modify a defined characteristic, pellicle of any vegetal powder, pellicle of mixture of any powder of vegetal origin and pellicle of vegetal powder or mixture of powders of vegetal origin with flavors and additives specific to provide final product with a defined characteristic. The material obtained may be immediately added again to the manufacturing process or be conditioned in proper packages for posterior industrial use or to be sold to interested industries.

Thus, the present invention was conceived aiming to obtain a industrial equipment and procedure for reconstituting powders of vegetal origin by lamination process, assembled with the minimal number possible of components, conveniently developed and conceived to allow it to perform its functions with efficiency and quality, showing outstanding practicality and versatility, incorporating a distinct performance. Its innovative design allows obtaining a disposition with excellent level of performance, being developed according to most modern techniques, thus allowing a simplified use, relative to industrial use.

It must be understood that the equipment developed for the application of the art is simple in its construction, therefore being of easy execution, thus obtaining excellent practical and functional results, incorporating an innovative conception of product, with high receptivity in the industrial sector.

The machinery for reconstituting vegetal powder is constructed with durable and resistant materials, providing users of the productive sectors with quality, economy, safety and simplicity, having great durability even when used in severe and aggressive conditions.

The invention claimed is:

1. A procedure for reconstituting tobacco by-products, comprising the steps of:

obtaining tobacco by-products from a group consisting of tobacco powder, tobacco particles, tobacco granules, tobacco pieces and combinations thereof, wherein the tobacco powder is obtained from tobacco stems, winnovers or winnowings;

milling said tobacco by-products with a hammer mill;

mixing said tobacco by-products that have been milled with 5-50 kg of an agglutinant compound, with flavoring and 100 Kg of vegetal powders selected from a group consisting of cinnamon, clove, mate herb and combinations thereof for about 10 minutes, and then adding about between 5 Kg to 100 Kg of water and mixing for about 10 more minutes using a ribbon blender mixer, resulting in a homogeneous substrate;

laminating said substrate between two linear and parallel lamination rolls to obtain a continuous pellicle having a thickness of between 0.05 mm and 2.5 mm and is free of marks, holes and deformities;

drying said pellicle at a temperature of between 100° C. and 400° C. in a heating chamber having a single, hollow internal cavity and a plurality of conveyors that are arranged in the cavity, extend along an entire length of the heating chamber and are configured so that the pellicle moves in a plurality of pass cycles through the heating chamber on the plurality of conveyors by transferring the pellicle directly from one of the plurality of conveyors to another one of the plurality of conveyors between a plurality of frontal drag rollers and a plurality of posterior drag rollers such that said conveyors to allow the pellicle to travel in a zigzag direction within the heating chamber with the cavity being hollow prior to inclusion of the conveyors to reduce the moisture of the pellicle to 8-20%;

removing the pellicle from a conveyor belt; and fragmenting or cutting said pellicle.

* * * * *